US005096084A

United States Patent [19]

Wells

[11] Patent Number: 5,096,084

[45] Date of Patent: Mar. 17, 1992

[54] TWO-PIECE MERCHANDISING CONTAINER

[75] Inventor: Cindy M. Wells, Madison, Wis.

[73] Assignee: Oscar Mayer Foods Corporation, Madison, Wis.

[21] Appl. No.: 636,516

[22] Filed: Dec. 28, 1990

[51] Int. Cl.[5] ..... B65D 51/04

[52] U.S. Cl. ..... 220/337; 220/340; 220/326; 220/307; 220/4.22

[58] Field of Search ..... 220/4.21, 4.22, 4.23, 220/306, 307, 324, 326, 337, 338, 339, 340; 229/2.5 R, 2.5 EC

[56] References Cited

U.S. PATENT DOCUMENTS

| | | | |
|---|---|---|---|
| 1,396,876 | 11/1921 | Platt | 220/337 |
| 3,144,973 | 8/1964 | Heintzelman . | |
| 3,276,656 | 10/1966 | Hartmann et al. | 229/2.5 EC |
| 3,372,854 | 3/1968 | Marcus | 229/2.5 EC |
| 3,459,360 | 8/1969 | Bagay . | |
| 3,536,251 | 10/1970 | Edwards . | |
| 3,558,057 | 1/1971 | Andrews . | |
| 3,576,271 | 4/1971 | Seeley | 220/337 |
| 3,767,110 | 10/1973 | Congleton . | |
| 3,851,789 | 12/1974 | Case et al. | 220/307 |
| 3,902,540 | 9/1975 | Commisso . | |
| 3,977,595 | 8/1976 | Hillgenberg . | |
| 3,985,289 | 10/1976 | Prince . | |
| 3,999,661 | 12/1976 | Jones . | |
| 4,013,214 | 3/1977 | Hansen et al. | 220/4.22 X |
| 4,057,169 | 11/1977 | Payne . | |
| 4,079,880 | 3/1978 | Edwards . | |
| 4,146,170 | 3/1979 | Mendendorp | 220/306 |
| 4,183,446 | 1/1980 | Davis . | |
| 4,216,862 | 8/1980 | Daenen | 206/541 |
| 4,244,470 | 1/1981 | Burnham . | |
| 4,253,600 | 3/1981 | Schubert | 229/2.5 R |
| 4,383,638 | 5/1983 | Bixler . | |
| 4,437,529 | 3/1984 | Fralish | 220/340 X |
| 4,570,818 | 2/1986 | Borst et al. . | |
| 4,602,719 | 10/1986 | Borst . | |
| 4,753,351 | 6/1988 | Guillin . | |
| 4,787,552 | 11/1988 | Natori . | |
| 4,842,143 | 6/1989 | McKee et al. . | |
| 4,892,220 | 1/1990 | Foos . | |
| 4,901,884 | 2/1990 | Kallenbach | 220/339 |
| 4,915,251 | 4/1990 | Payne | 220/306 |
| 4,971,220 | 11/1990 | Kaufmann et al. . | |
| 4,986,438 | 1/1991 | Borst | 220/315 |

FOREIGN PATENT DOCUMENTS

| | | | |
|---|---|---|---|
| 2589443 | 5/1987 | France | 229/2.5 EC |

*Primary Examiner*—Gary E. Elkins
*Assistant Examiner*—Stephen Cronin
*Attorney, Agent, or Firm*—Lockwood, Alex, Fitzgibbons & Cummings

[57] ABSTRACT

A rigid two-piece plastic merchandising container is provided. The merchandising container is suitable for storing food products such as sandwich type products within warming ovens useful in self-serve food store operations. The merchandising container includes a sealing peripheral lip structure, an interlocking hinge assembly portion, and a locking assembly which cooperates with the hinge assembly to ensure constant closure of the merchandising container until the locking assembly is precisely manipulated through an unlocking procedure.

29 Claims, 3 Drawing Sheets

TWO-PIECE MERCHANDISING CONTAINER

BACKGROUND AND DESCRIPTION OF THE INVENTION

The present invention generally relates to merchandising containers for food products which enable the food products to be stored at elevated temperatures for extended time periods without any significant deterioration of food quality. More particularly, the present invention relates to a two-piece merchandising container molded from so-called rigid synthetic plastic materials which merchandising container halves are sized and shaped to merchandise and store ready-to-eat food products in a manner for immediate consumption without assembly, heating or other handling procedures. The merchandising container includes a tray portion and a separate cover portion that interlock together at a hinge assembly and which exhibit a tight interference fit with each other. Additionally, a positive, gravity-resistant locking assembly is included for keeping the merchandising container halves together in a closed position even while the container is lifted and transported when only the cover portion thereof is grasped by the customer.

Containers for merchandising food products including so-called fast-food items such as hamburger sandwiches, hot dog sandwiches and other sandwiches incorporating meats and/or cheeses within bread, a bun, or other dough-like food items, are generally well-known. Many of these merchandising containers are constructed of foamed polymers, paperboards, foils and the like which are usually non-transparent, making it impossible to inspect the food item prior to purchase without handling and opening the merchandising container. In many fast-food types of operations, non-transparent packaging is acceptable, if not desirable, because employees of the fast-food store select the packaged item and deliver it to the customer without any opportunity for the customer to choose specific containerized food products. Also, the identity of the fast-food product within the container is designated by wording and/or color coding which is easily discernible from viewing the outside of the merchandising container. Additionally, the selection process in these types of fast-food operations often is further facilitated by providing numerous merchandising compartments, each being designated for a specific type of fast-food item.

In fast-food stores such as these wherein an employee of the store selects and transports the containerized food item from a temporary holding location to a bag or tray which is then presented to the customer, the store can rely upon the experience of its employee and the employee's familiarity with the merchandising containers in order to be certain that the containerized fast-food is delivered to the customer without mishap. In these types of merchandising operations, the experience and/or training of the employee will be important in generally ensuring that the containerized food product will remain within the merchandising container because the employee will be aware of the proper manner of handling the containerized food product without inadvertent opening of the merchandising container and possible spillage of the food product out of its container. Accordingly, in these types of operations, merchandising container locking means typically are not especially secure.

Other types of fast-food stores have a self-service aspect whereby the customer is the one who removes the containerized food product from a warming location, typically for transport to another location in the store at which the containerized ready-to-eat food product is purchased. In these types of operations, it is important that the container will not inadvertently open when it is handled in a less-than-desirable manner, such as by having the customer grasp the container by only its cover portion. In addition, in at least some of these types of self-service stores, the customer has the ability to select among several different containers, each of which contains the same type of food product, such as a hot dog in a bun, or the like. In these instances, a customer may have an inclination to inspect the containerized food products, such as opening the merchandising container in order to inspect for freshness, size, and the like. Such inspection is generally not desirable from at least a public health and safety point of view. It would therefore be desirable to provide transparent or substantially transparent containers which permit inspection without opening the package and which provide a locking feature that requires conscious manipulation thereof in order to open the package so that it will not become inadvertently opened.

Another consideration for marketing ready-to-eat food products is to take steps in order to maintain the freshness and consistency of the food product within the container during the time that the containerized food product is stored in a heated state so that it is at a temperature preferred for consumption. Many prior art merchandising containers do not provide an adequate seal where the container portions meet so as to maintain desired humidity conditions within the container, and/or components such as buns, breads and the like tend to stick to the portion of the container within which it is in contact, particularly after storage at consumption temperatures for substantial time periods.

In summary, the present invention is particularly well suited for self-serve retail outlets for ready-to-eat food products that may be stored at elevated consumption temperatures for extended time periods on the order of up to four hours or so while still maintaining the freshness and product consistency desired for a product of this type. The merchandising container is a generally rigid two-piece container constructed from synthetic plastics, at least one of the container two pieces being preferably transparent, and which will withstand storage at elevated temperatures without damage or deterioration.

The merchandising container has a generally clamshell type of structure including a tray portion and a separate cover portion which positively combine to enclose a food product such as a hot dog and bun, sandwich or the like. The tray portion and cover portion are joined together by an interlocking hinge assembly, preferably one that, once assembled, remains interlocked whether the container is opened or closed. A positive locking structure is provided generally opposite to the hinge assembly. The tray portion and cover portion of the container further have substantially complementary generally vertical engagement surfaces on their respective perimeters in order to provide an interference fit. Preferably, the base of the tray has a series of generally concentric formed ridges to inhibit sticking of the food product to the base.

It is accordingly a general object of the present invention to provide an improved, rigid two-piece merchandising container.

Another object of the present invention is to provide an improved merchandising container that provides superior storage for extended time periods of heated ready-to-eat food products such as hot sandwiches and the like.

Still another object of this invention is to provide an improved merchandising container having a locking system that allows the filled container to be held from its top portion without having the container fall open and expose or drop the food product.

Another object of this invention is to provide an improved two-piece merchandising container having interference fit characteristics to provide a closed system that allows bread products and the like to remain soft and moist when stored within a forced air type of warming oven or other warming oven for at least four hours.

Yet another object of the present invention is to provide a two-piece rigid container wherein the container bottom portions may be formed out of an ovenable material and wherein the container top portion can be easily assembled together with the container bottom portion into a reliable, hinged rigid container having a gravity resistant lock assembly.

Another object of the present invention is to provide an improved rigid two-piece merchandising container that has a gravity-sensitive lock structure to prevent inadvertent opening of the package when the top portion only thereof is grasped.

In accordance with a further object of the present invention, the rigid package has an intermediate flange extending around its periphery which allows the package to be suspended in a specially designed rack, thereby providing a unique combination of package and merchandising rack requiring a package that is similarly sized and that has a similar flange.

These and other objects, features and advantages of the present invention will be clearly understood through a consideration of the following detailed description.

BRIEF DESCRIPTION OF THE DRAWINGS

In the course of this description, reference will be made to the attached drawings, wherein.

DESCRIPTION OF THE PARTICULAR EMBODIMENTS

Figure 1:
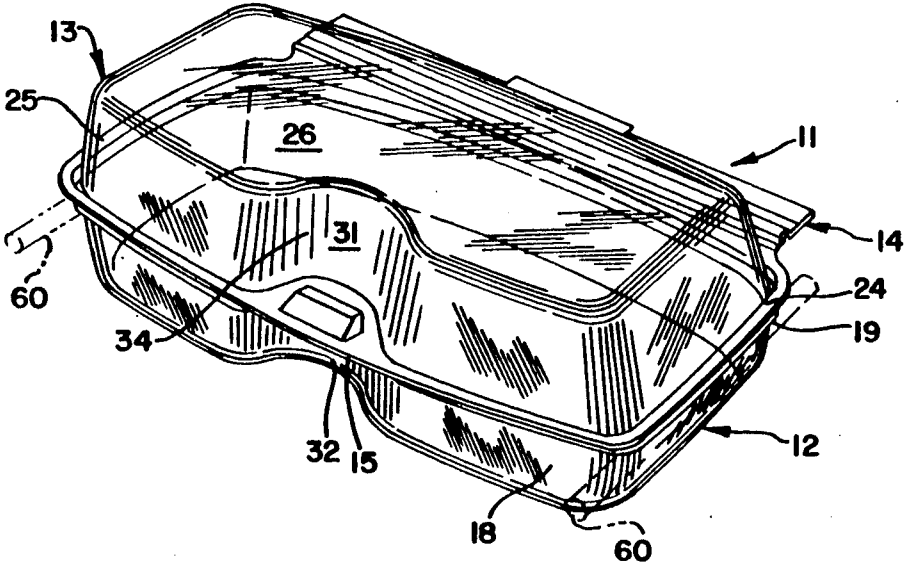
FIG. 1 is a perspective view of a preferred two-piece merchandising container according to the present invention.

A one-piece merchandising container according to the present invention, generally designated as 11 in FIG. 1, includes a bottom or tray portion, generally designated as 12, and a top or cover portion, generally designated as 13. The separate tray portion 12 and cover portion 13 are joined together by a hinge assembly, generally designated as 14, at an end portion thereof and a lock assembly, generally designated as 15, which is positioned at a location or end portion thereof which generally opposes the hinge assembly 14. A food product (not shown) such as a sandwich including a hot dog within a bun, or the like will conveniently fit within a food product recess 50 between the tray portion 12 and the cover portion 13 when the hinge assembly 14 is engaged and the lock assembly 15 is closed, as illustrated in FIG. 1. In the typical arrangement, the food product will generally fill the closed marketing container 11.

The tray portion 12 includes an elongated bottom section 16 at the base of the product recess 50 which preferably includes a plurality of ridges, or upstanding ribs, 17 which present a raised support surface having a minimal cross-section The ridges 17 raise the food product when it is stored in the product recess 50 so that the same does not simply rest on the bottom surface of bottom section 16, this feature being especially advantageous in preventing product sticking and sogginess of any bread components of the food product which would otherwise rest upon the comparatively large surface area of the bottom section 16.

A generally upstanding lower sidewall 18 further defines the product recess 50 of the tray portion 12. The sidewall 18 includes a peripheral lip portion 19 which extends around the lower sidewall 18 generally in a plane generally perpendicular to the plane of the bottom section 16 of the tray portion 12. The lip portion 19 preferably terminates at its uppermost extent in a peripheral flange or rim 21. An intermediate flange 22, which is generally perpendicular to the peripheral lip portion 19, can be positioned between the generally upstanding sidewall 18 and the peripheral lip portion 19 shown in the Figures as beneath the peripheral lip portions 19. This intermediate flange 22 preferably extends around a portion of the tray portion 12 for a distance sufficient to adequately support the container 11 therefrom in a heated environment, shown as a rack 60 in phantom.

Preferably, the peripheral lip portion 19 has a draft angle "A", nominally 0°, which typically correlates in actual formation of the container 11 to an actual draft angle of approximately 1°. The generally upstanding sidewall 18 has a typical draft angle "B" which is somewhat larger, typically on the order of roughly 5° to 20°, depending upon the shape of the tray portion 12. Whatever the actual configuration of the generally upstanding sidewall 18, it is important that the draft angle "A" be substantially the same as the draft angle "C" of a corresponding peripheral lip portion 23 of the separate cover portion 13. This relationship provides a reliable interference fit that is important in providing the closed system characteristics of the merchandising container 11 which permits the products therewithin to remain fresh, such as allowing bread products to remain soft and moist, while the filled merchandising container remains within a forced air type of warming oven or other type of warming oven for at least four hours.

These closed system characteristics are preferably further enhanced by the particular structure of the cover portion 13, which has an overall configuration which is generally complementary to that of the tray portion 12. In this regard, a peripheral flange 24 extends along the entire free periphery of the peripheral lip portion 23 such that the peripheral flange 24 of the cover portion 13 is in general engagement with the peripheral flange 21 of the tray portion 12. A sidewall 25 of the cover portion 13 extends downwardly to join a top section 26 thereof to the peripheral lip portion 23. As illustrated, it is preferred that this sidewall 25 extends generally behind the peripheral lip portion 23, which is formed as a folded-over or cuffed portion of the sidewall 25. As is the case for sidewall 18 of the tray portion 12, the sidewall 25 of the cover portion 13 will typically have a draft angle substantially larger than draft angle "C" of the peripheral lip portion 23.

In the illustrated embodiment, cover portion 13 and the tray portion 12 are joined together by the hinge assembly 14, as perhaps best seen in FIGS. 2A, 2B, 5 and 7. The hinge assembly 14 has two separate components, a tray component 100 and a cover component 102, respectively which interlock together to form a reliable gravity-resistant hinge. The tray portion component 100 thereof has a relatively wide profile (FIGS. 2A and 2B) and preferably includes a longitudinal section or formed extension portion 104 extending along an end portion of the container 11. The formed tray extension portion 104 preferably has a series of ridge or ribs 106 formed therein to provide desired rigidity and to provide the hinge assembly 14 with a plurality of engagement channels 105, as will be explained in greater detail below. A slot 108 is formed midway in the tray extension 104 and has a length sufficient to accommodate the cover portion hinge assembly component 102 therein in an interfitting relationship.

Figure 5:
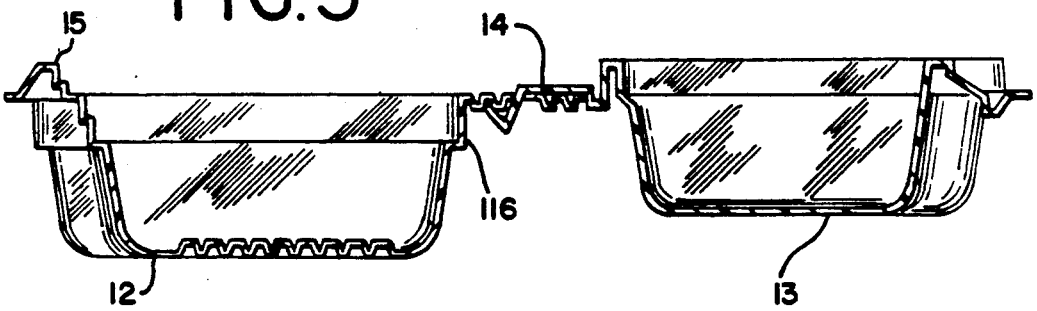
FIG. 5 is an elevational view of the container shown in FIG. 1 shown in an opened orientation.

Similar to the tray portion component 100, the cover portion hinge assembly component 102 also includes a longitudinal section or extension portion 110 formed as part of the container cover portion 13 and extending along a corresponding end portion of the cover portion 13. The cover extension portion 110 has a length which is less than the tray extension portion 104 and which is generally equal to the length of the tray extension slot 108. The cover extension 110 also has a width sufficient to allow secure operational engagement by it of the tray extension 104. The formed cover extension 110 includes an inner flap 112, an intermediate engagement recess 114 and an outer, extending engagement tang 120 which extends upwardly to provide a V-shaped hook 122 at the end of the cover extension 110. To assemble the container 11, the cover extension 110 is passed through the tray extension slot 108 so that the engagement tang 120 engages one of the grooves or channels 105 on the underside 116 of the tray extension 104, which channels 105 are disposed between the tray extension ribs 106 when the container 11 is in an open state as shown in FIG. 5. In addition, the outermost portion 111 of the tray extension 104 abuts an inner wall 115 of the tray extension recess 114.

Figure 7:
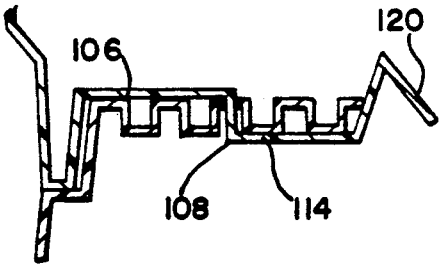
FIG. 7 is an enlarged cross-sectional view taken along line 8—8 of FIG. 1 at an opposite end portion of the illustrated container, showing the hinge assembly in its engaged state when the container is in its closed state.

When the container 11 is in a closed state, as is shown in FIG. 7, the inner wall 115 of the cover extension recess 114 extends through the tray extension slot 108 and abuts an adjacent engagement rib 106 of the tray extension 104, to provide a reliable connection between the two container halves 12 and 13.

Interference fit characteristics as described above which are provided by the tray and cover portion lip portions 19 and 23 typically are not sufficient to insure the package will not fall open during transport thereof, which function is usually provided by the lock assembly 15.

The preferred lock assembly 15 of the container 11 is generally located within and between an indentation 31 of the cover portion sidewall 25 and a corresponding, similar indentation 32 of tray portion sidewall 18. A protruding part of the cover tray, generally designated as 33, is located substantially within the cover portion indentation 31 and is typically supported in generally cantilevered fashion from an indented portion 34 of the cover portion peripheral flange 24. The protruding part 33 includes a raised engagement member or boss 35 having at least one engagement edge 36. The engagement member or boss 35 may include an exterior rib member 80 integrally formed in the cover protruding part 33 which serves to stiffen the same and ensure positive engagement by the boss 35 with the tray receptacle 37.

Figure 6:
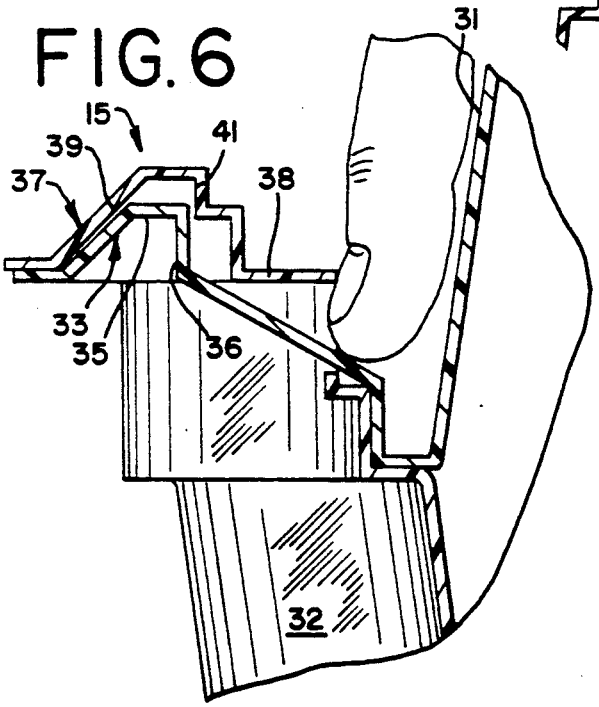
FIG. 6 is a cross-sectional view taken along line 6—6 of FIG. 1 at an end portion of the illustrated container, showing a preferred lock assembly in its closed state.

The lock assembly 15 further includes a generally hollow tray portion receptacle member, generally designated as 37, which is adapted to receive the cover portion protruding part 33. The tray receptacle member 37 is positioned substantially within the tray portion indentation 32 and generally extends along the tray portion peripheral flange 21. The receptacle 37 includes a slot or opening 38 formed, such as by punching, in the tray portion peripheral flange 21 and disposed proximate to the rear of the receptacle 37, which slot is large enough to permit passage therethrough of the cover portion protruding part 33, such passage being accomplished by digital forces that are intentionally and somewhat precisely directed onto the cover portion indentation 31. Receptacle number 37 further includes a raised, sloped member 39, or protuberance having a forward sloped engagement edge and a rearward stop edge 41. By this structure, the cover portion boss 35 mates within the tray indentation protuberance 39 when the merchandising container 11 is fully closed, as illustrated in FIGS. 1 and 6. A gravity-resistant locking feature is thus provided because the cover boss 35 is seated within the tray or lower container receptacle 37 and consequently, the weight of the food product therein will ensure proper engagement.

In the fully closed orientation, the engagement edge 36 of the boss 35 may be in contact with the stop edge 41 of the cover protuberance 39 in order to provide a gravity-sensitive condition to the lock assembly 15. More specifically, by this structure, the merchandising container 11 will not inadvertently open when the container 11 is picked up in a manner so as to be supported only by the cover portion 13, even when accompanied by jostling or shaking thereof by the customer, and even when the merchandising container 11 is filled with a typical food product, which will generally weigh approximately 8 ounces. Until the cover portion protuberance 39 is specifically manipulated by the user as illustrated in FIG. 6, the merchandising container 11 will remain closed. This condition is maintained whether the package is at room temperature or at an elevated temperature suitable for consumption of the heated product therewithin.

The lock assembly 15 that is illustrated and described herein is especially advantageous in that is requires only minimal additional plastic film material in order to form same during a typical molding operation. It is noted that both the cover protruding part 33 and the tray receptacle 37 lie substantially within the respective areas bounded by the cover and tray respective flanges.

Figure 2A:
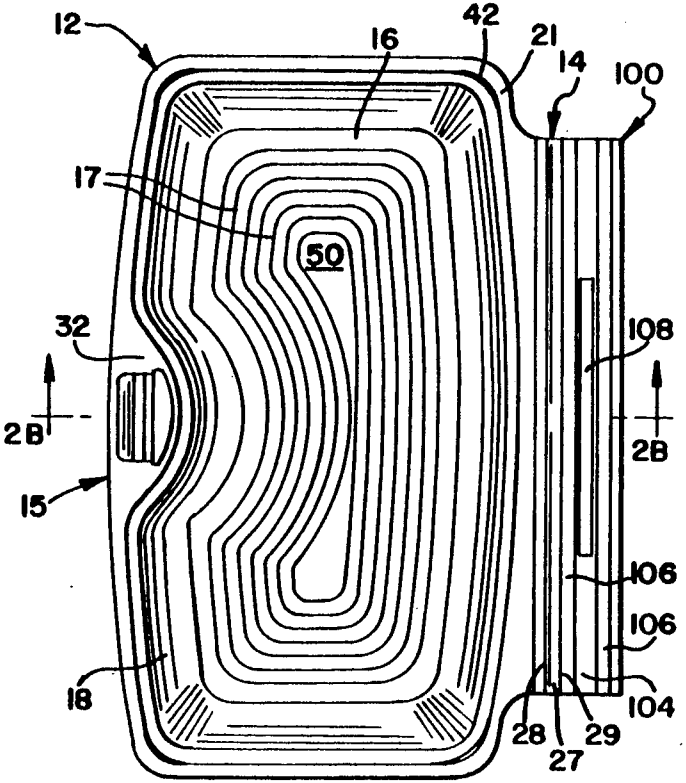
FIG. 2A is a plan view of the bottom, or tray portion of the merchandising container of FIG. 1.
Figure 2B:
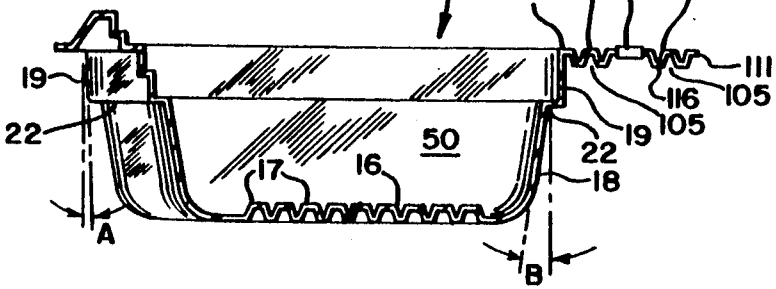
FIG. 2B is a cross-sectional view taken along line B—B of FIG. 2A.
Figure 3A:
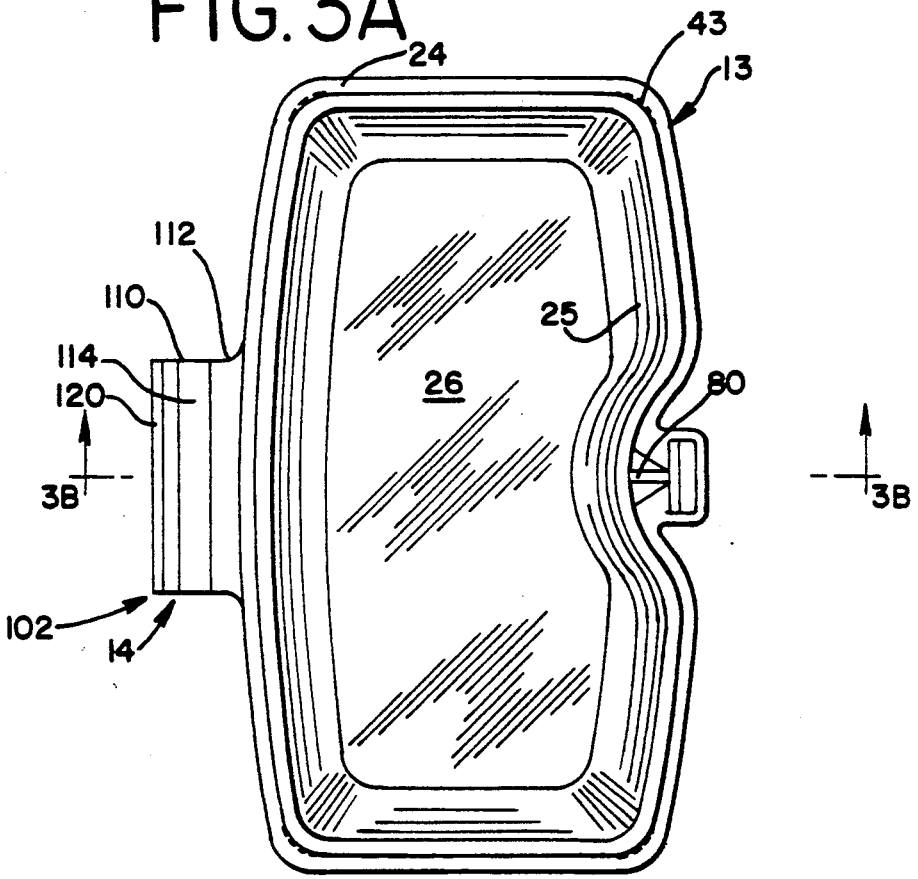
FIG. 3A is a plan view of the top, or cover, portion of the container shown in FIG. 1.
Figure 3B:
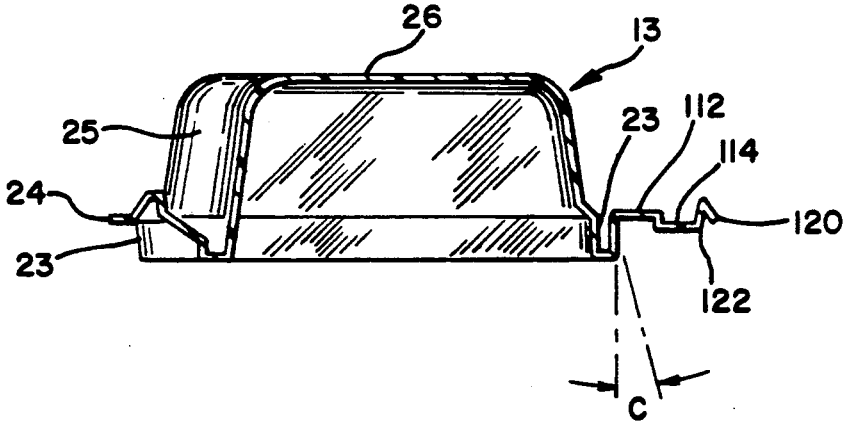
FIG. 3B is a cross-sectional view taken along line B—B of FIG. 3.
Figure 4:
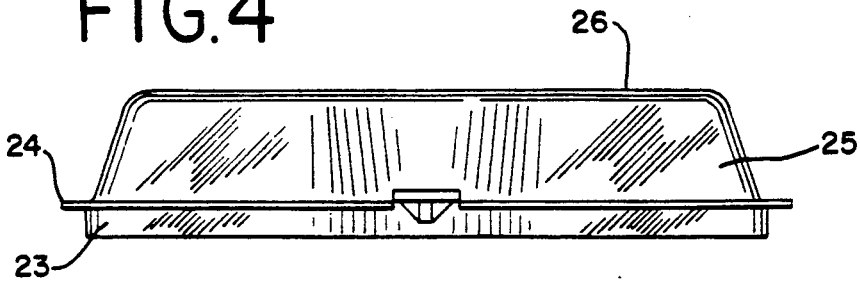
FIG. 4 is an elevational view of the front of the container cover portion of FIG. 3A.
Figure 8:
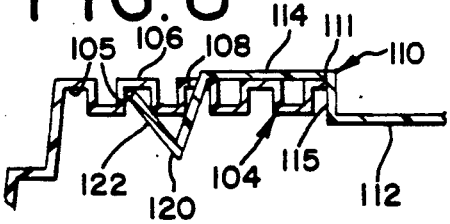
FIG. 8 is an enlarged cross-sectional view taken along line 7—7 of FIG. 1 at an opposite end portion of the illustrated container, showing the hinge assembly in its engaged state when the container is in its open state.

In addition, corner snap locking profiles can be included to complete closure with proper seating of the package components. These corner locking profiles are best seen in FIGS. 2A and 3A. A projection 42 is shown in peripheral lip portion 19 of tray portion 12, and a mating indent 43 is shown in peripheral lip portion of cover portion 13.

The two halves of the merchandising container 11 are preferably made of a plastic material or film that will not be damaged, deformed, discolored or degraded in appearance when it is used within a warming oven of a type suitable for self-serve food stores. In this regard, the tray portion 12 of the container may be formed from an ovenable material, such as a crystallized polyester or the like where the food product will be reheated in the tray portion or from a talc-filled polypropylene where a cost reduction is desired. The cover portion 13 may be formed from plastics such as clarified polypropylene. If desired, the tray portion 12 may be formed from a substantially opaque material while the cover portion 13 may be formed from a substantially transparent material which will allow the ultimate purchaser and end user of the product held in the container to easily inspect the same without the need for opening the container.

A typical warming oven used for such containers is a forced convection oven having an exhaust vent, and a typical merchandising container 11 according to the present invention will maintain its initial shape and appearance when being stored within such an oven at approximately 150° to 170° F. for at least four hours. It is also preferred that the material or film of the cover portion 13 be substantially transparent in order to provide the customer with the ability to easily inspect the food product within the merchandising container 11 without any need for attempting to open the merchandising container. Exemplary plastic materials or films which exhibit all of these properties are various transparent polypropylene sheets.

It will thus be seen that the present invention provides a new and useful merchandising container, which merchandising container has a number of advantages and characteristics, including those pointed out herein and others which are inherent in the invention. Preferred embodiments of the invention have been described by way of example, and it is anticipated that modifications may be made to the described form without departing from the spirit of the invention or the scope of the appended claims.

I claim:

1. A generally rigid, two-piece plastic merchandising container for storing ready-to-eat food products at elevated consumption temperatures, the two pieces of said merchandising container being operable between a first position and a second position, the merchandising container comprising, in combination:

a tray portion having a bottom section and a generally upstanding sidewall, said generally upstanding sidewall having a peripheral lip having a designated draft angle;

a cover portion having a top section and a peripheral lip, the cover portion peripheral lip having a draft angle substantially the same as the designated draft angle of the tray portion peripheral lip, said tray portion peripheral lip and said cover portion peripheral lip being substantially complementary in size and shape to provide an interference fit between said tray portion and said cover portion;

said tray portion and said cover portion are sized and shaped for enclosing therewithin a ready-to-eat heated food product;

a hinge assembly joining said tray portion and said cover portion together into a combined two-piece merchandising container and permitting relative movement of said container tray and cover portions between said first and second positions, and tray portion, cover portion and hinge portion being made of a plastic material capable of withstanding damage upon being subjected to elevated food consumption temperatures for up to four hours and more, said hinge assembly including an extension formed in said tray portion, the tray extension having an engagement slot therein, said tray extension further including at least one engagement rib disposed on a first half thereof on one side of said engagement slot, an extension portion formed in said cover portion, the cover extension including hook means adapted to pass through the tray extension engagement slot to engage a portion of said tray extension engagement rib when said container tray and cover portions are in said first position, said cover extension further including recess means, the recess means engaging a second half of said tray extension which is disposed on an other side of said engagement slot when said container tray and cover portions are in said second position; and means for locking said tray portion and said cover portion together at a location generally opposite to said hinge assembly, said locking means being generally positioned within an indented portion of said tray portion and an indented portion of said cover portion, said locking means having two engaging components for preventing inadvertent opening of said tray portion of the merchandising container.

2. The merchandising container according to claim 1, wherein said locking means includes a protruding part and a receptacle part, said protruding part having a raised engagement boss, said receptacle part having a raised, hollow cavity for receiving said raised engagement boss in a locking orientation, said receptacle part further including slot means for permitting movement of said raised engagement boss therethrough.

3. The merchandising container according to claim 2, wherein said two engaging components of the locking means are a stop edge of said receptacle part and an engagement edge of the protruding part, and said stop edge and engagement edge contact each other when the locking means is in its locked orientation.

4. The merchandising container according to claim 2, wherein said raised engagement boss closely mates within said raised hollow cavity when said locking means is fully closed.

5. The merchandising container according to claim 1, wherein said designated draft angle is a draft angle having a nominal value of approximately 0°.

6. The merchandising container according to claim 1, wherein said locking means includes a part protruding from said cover portion, said cover portion protruding part having a raised engagement element, said cover portion protruding part having a raised, sloped wall extending generally upwardly and outwardly from said cover portion, said locking means further including a receptacle formed in said tray portion, said receptacle having a raised, generally hollow cavity adapted to receive said cover portion engagement element, said receptacle further including slot means for accommodating the passage of said cover portion protruding part sloped wall therethrough, said cover portion protruding part sloped wall having means for directing said cover portion raised engagement element into locking contact with said tray portion receptacle.

7. The merchandising container according to claim 1, further including a peripheral flange at a free edge of said tray portion peripheral lip, a peripheral flange at a free edge of said cover portion peripheral lip, and said respective peripheral flanges are in general engagement with each other when the merchandising container is in its closed orientation.

8. The merchandising container according to claim 1, wherein said hinge assembly tray extension includes first and second engagement ribs disposed on opposing sides of said tray extension engagement slot, said hinge assembly cover extension hook means engaging said first engagement ribs when said merchandising container is in said first position and said recess means engaging said second engagement ribs when said merchandising container is in said second position.

9. The merchandising container according to claim 1, wherein said hinge assembly tray extension portion includes a longitudinal extension portion, said engagement rib being disposed on said tray longitudinal extension portion, and said hinge assembly cover extension portion includes a longitudinal extension portion having flexible engagement tab means thereon, said cover extension portion flexible engagement tab means hingedly engaging said engagement rib.

10. The merchandising container according to claim 9, wherein said cover extension portion flexible tab means includes an inner flap portion, an outer hook portion and an intermediate recess portion disposed therebetween, the outer hook portion being adapted to engage said tray extension portion engagement rib.

11. The merchandising container according to claim 10, wherein said tray extension portion includes at least first and second engagement ribs, said first and second engagement ribs being disposed on opposite sides of said engagement slot.

12. The merchandising container according to claim 1, wherein said tray extension portion extension engagement slot is disposed in said tray extension between first and second engagement ribs, said cover extension portion including tab means having an inner tab portion, an intermediate tab portion and an outer tab portion, said outer tab portion including flexible hook means adapted to engage said tray extension first engagement rib and said intermediate tab portion being adapted to engage said tray extension second engagement rib when said container is in said first position.

13. The merchandising container according to claim 1, wherein said tray portion peripheral lip and said cover portion peripheral lip have engagement surfaces with a substantially vertically extending orientation.

14. The merchandising container according to claim 13, further including a substantially horizontal peripheral flange at a free edge of each of said substantially vertically extending peripheral lips, and said respective horizontal peripheral flanges engage each other when the merchandising container is in said second position.

15. The merchandising container according to claim 1, wherein an intermediate flange is provided between said tray portion sidewall and said tray portion peripheral lip, and wherein the cover portion sidewall extends behind the cover portion peripheral lip to define a generally U-shaped surface, and wherein said intermediate flange and said U-shaped surface engage each other when the merchandising container is in said second position.

16. The merchandising container according to claim 1, further including upstanding ridges in said tray portion bottom section.

17. The merchandising container according to claim 1, wherein said cover portion is a molded piece of substantially transparent sheet plastic.

18. The merchandising container according to claim 1, wherein said tray portion is a molded piece of substantially opaque sheet plastic.

19. The merchandising container according to claim 17, wherein said tray portion is a molded from a material which is different from the material which said cover portion is molded from.

20. The merchandising, container according to claim 1, further including at least one snap locking profile structure having a profile component along said tray portion peripheral lip and a complementary profile component along said cover portion peripheral lip.

21. The merchandiser assembly according to claim 20, wherein said snap locking profile structure is located in at least one corner of said respective peripheral lips.

22. A generally rigid two-piece plastic merchandising container for storing ready-to-eat food products at elevated consumption temperatures, the merchandising container comprising: a substantially transparent cover portion capable of withstanding damage upon being subjected to elevated food consumption temperatures; a substantially non-transparent tray portion having a bottom section and a generally upstanding sidewall, said bottom section including upstanding ridges, and said generally upstanding sidewall having a peripheral lip having a draft angle of a nominal 0° value; said cover portion having a top section and a peripheral lip having a draft angle of a nominal 0° value, said tray portion peripheral lip and said cover portion peripheral lip being substantially complementary in size and shape to provide an interference fit between said tray portion and said cover portion; said tray portion and said cover portion are sized and shaped for enclosing therewithin a ready-to-eat heated food product; a hinge assembly interlockingly joining said tray portion and said cover portion together into a merchandising container operable between a first, closed position and a second, open position, the merchandising container having a generally clamshell structure the hinge assembly including a tray extension having an engagement slot and a cover extension which is adapted to pass through said tray extension engagement slot, said tray extension further including engagement ribs disposed on opposite sides of said engagement slot and said cover extension including hook means and recess means, said hook means engaging said engagement ribs and said recess means engaging said engagement ribs; and means for locking said tray portion and said cover portion together at a location generally opposite to said hinge assembly, said locking means including a protruding element and a receptacle element, said protruding element having a raised engagement boss, said receptacle element having a raised concave cavity for receiving said raised engagement boss in a locking orientation, and said receptacle element further including slot means for permitting movement of said raised engagement boss therethrough.

23. The merchandising container according to claim 22, wherein said receptacle element includes a stop edge that engages an engagement edge of the protruding element when the locking means is in its locked orientation.

24. The merchandising container according to claim 22, wherein said raised engagement boss closely mates within said raised concave cavity when said locking means is fully closed.

25. The merchandising container according to claim 22, wherein aid protruding element protrudes from said container cover portion and said receptacle element extends from said container tray portion, said protruding element and said receptacle element each including a sloped leading engagement edge which engage each other.

26. The merchandising container according to claim 22, wherein said tray portion peripheral lip and said cover portion peripheral lip each have a substantially vertically extending orientation, a substantially horizontal peripheral flange is provided at a free edge of each of said substantially vertically extending peripheral lips, and said respective horizontal peripheral flanges engage each other when the merchandising container is in its closed orientation.

27. The merchandising container according to claim 22, wherein an intermediate flange is provided between said tray portion sidewall and said tray portion peripheral lip, and wherein the cover portion sidewall extends behind the cover portion peripheral lip to define a generally U-shaped surface, and wherein said intermediate flange and said U-shaped surface engage each other when the merchandising container is in its closed orientation.

28. The merchandising container of claim 22, wherein said recess means engages said first engagement ribs when said container is in said first position and said recess means engages said second engagement ribs when said container is in said second position.

29. A generally rigid, two-piece plastic merchandising container for storing ready-to-eat food products at elevated consumption temperatures, the two pieces of said merchandising container being operable between a first position and a second position, the merchandising container comprising, in combination:

a tray portion having a bottom section and a generally upstanding sidewall, said generally upstanding sidewall having a peripheral lip having a designated draft angle;

a cover portion having a top section and a peripheral lip, the cover portion peripheral lip having a draft angle substantially the same as the designated draft angle of the tray portion peripheral lip, said tray portion peripheral lip and said cover portion peripheral lip being substantially complementary in size and shape to provide an interference fit between said tray portion and said cover portion;

said tray portion and said cover portion are sized and shaped for enclosing therewithin a ready-to-eat heated food product;

a hinge assembly joining said tray portion and said cover portion together into a combined two-piece merchandising container and permitting relative movement of said container tray and cover portions between said first and second positions, said tray portion, cover portion and hinge portion being made of a plastic material capable of withstanding damage upon being subjected to elevated food consumption temperatures for up to four hours and more, said hinge assembly including an extension formed in said tray portion, the tray extension having an engagement slot therein, an extension portion formed in said cover portion, the cover extension being adapted to pass through the tray extension engagement slot, said cover extension having means to engage a portion of said tray extension when said container tray and cover portions are in either of said first or second positions, said hinge assembly tray extension portion further including a longitudinal extension portion having at least one engagement means disposed on a surface thereof and said hinge assembly cover extension portion including a longitudinal extension portion having flexible engagement tab means thereon, said cover extension portion flexible engagement tab means hingedly engaging said tray extension portion engagement means, said cover extension portion flexible tab means including an inner flap portion, an outer hook portion and an intermediate recess portion disposed therebetween, the outer hook portion being adapted to engage said tray extension portion engagement means; and means for locking said tray portion and said cover portion together at a location generally opposite to said hinge assembly, said locking means being generally positioned within an indented portion of said tray portion and an indented portion of said cover portion, said locking means having two engaging components for preventing inadvertent opening of said tray portion of the merchandising container.

* * * * *